US006912867B2

(12) United States Patent
Busick

(10) Patent No.: US 6,912,867 B2
(45) Date of Patent: Jul. 5, 2005

(54) COMBINED WATER COOLER AND REFRIGERATOR UNIT

(75) Inventor: Louis M. Busick, Westerville, OH (US)

(73) Assignee: Oasis Corporation, Columbus, OH (US)

( * ) Notice: Subject to any disclaimer, the term of this patent is extended or adjusted under 35 U.S.C. 154(b) by 0 days.

(21) Appl. No.: 10/840,924

(22) Filed: May 6, 2004

(65) Prior Publication Data

US 2004/0226313 A1 Nov. 18, 2004

Related U.S. Application Data

(60) Provisional application No. 60/470,776, filed on May 13, 2003.

(51) Int. Cl.[7] ..... F25D 23/12
(52) U.S. Cl. ..... 62/338; 62/389
(58) Field of Search ..... 62/198, 199, 200, 62/337, 338, 339, 389–400; 222/146.6

(56) References Cited

U.S. PATENT DOCUMENTS 1,994,698 A * 3/1935 Evers, Jr. ..... 62/223
2,191,623 A * 2/1940 Philipp ..... 62/213
2,349,367 A * 5/1944 Muffly ..... 62/214
2,540,343 A * 2/1951 Muffly ..... 62/430
2,605,621 A * 8/1952 Kellershon ..... 62/204
2,641,109 A * 6/1953 Muffly ..... 62/199
3,786,648 A * 1/1974 Rice ..... 62/200

* cited by examiner

*Primary Examiner*—William E. Tapolcai
(74) *Attorney, Agent, or Firm*—Kelly Lowry & Kelley, LLP

(57) ABSTRACT

A combination water cooler and refrigerator unit is provided including a lower cabinet defining a refrigerated compartment, and an upper water reservoir for receiving a supply of water from a water source, such as an inverted water bottle. A refrigeration system mounted within the cabinet includes a chiller coil having a first segment for chilling the refrigerated compartment, and a second segment for chilling water within the water reservoir. In addition, a lower end of the water reservoir is positioned in heat transfer relation with an upper region of the refrigerated compartment, and a single thermostatic temperature control sensor is mounted within the refrigerated compartment for regulating the refrigeration system for substantially eliminating risk of reservoir or refrigerator freeze up.

22 Claims, 10 Drawing Sheets

COMBINED WATER COOLER AND REFRIGERATOR UNIT

BACKGROUND OF THE INVENTION

This application claims the benefit of U.S. Provisional Application 60/470,776, filed May 13, 2003.

This invention relates generally to improvements in refrigerated water coolers of the type having a water reservoir for receiving and storing a supply of water, and for selectively dispensing water from the reservoir. More particularly, this invention relates to an improved water cooler combined with a refrigerated compartment for receiving and chilling selected items, wherein the water reservoir and refrigerated compartment are chilled by means of a common refrigeration system, and further wherein the water reservoir is positioned in heat transfer relation with the refrigerated compartment for substantially eliminating risk of reservoir freeze-up.

Water coolers in general are well known in the art for containing a supply of relatively purified water in a convenient manner and location ready for substantially immediate dispensing and use. Such water coolers commonly include an upwardly open water reservoir mounted within a cooler housing or cabinet adapted to receive and support an inverted water bottle of typically three to five gallon capacity. The water within the bottle flows downwardly into the underlying water reservoir for selective dispensing therefrom through one or more faucet valves located in an accessible position on the front of the cooler housing. In some designs, the water reservoir is coupled to an alternative water supply such as a water purification device or system, e.g., a filtration system or a reverse osmosis system, in lieu of a water supply contained within an inverted water bottle. Such water coolers are widely used to provide a safe and clean source of water for drinking and cooking, especially in areas where the local water supply is suspected to contain undesired levels of contaminants.

In many water coolers, a refrigeration system is mounted within the cooler cabinet and includes a chiller coil or the like for maintaining water within the reservoir within a chilled condition. In other configurations, the reservoir is subdivided into distinct chambers, one of which is associated with the refrigeration system, whereas at least one other chamber is provided for containing water at a different temperature such as substantially room temperature water. Further, in some cases, an additional chamber is provided in association with a heating element to provide a supply of hot water. In such coolers of the multichamber type, multiple faucet valves are provided in flow communication with the respective water chambers to permit separate dispensing of the water at the different temperatures.

In some instances, a refrigerated water cooler has been combined with a compact refrigerator to provide a dual purpose product providing a supply of chilled water together with a refrigerated compartment for receiving and chilling selected articles, such as canned or bottled beverages. In general, however, the chiller load requirements associated with the water cooler and the refrigerator components are sufficiently different so as to require a relatively complex refrigeration system and related thermostatic temperature control scheme. That is, the water cooler and the refrigerated compartment represent different chiller loads which may demand refrigeration alternately or simultaneously. As a result, the refrigeration system in such combined products has typically comprised a dual zone system having sufficient chiller capacity and a dual thermostatic temperature control scheme for separately but simultaneously handling both chiller loads. Attempts to provide a more simplified refrigeration system of potentially reduced chiller capacity and having a single or common thermostatic temperature control sensor for regulating both chiller loads have suffered from undesirable overchilling of the water cooler or the refrigerated compartment, when chilling is required by one but not both of these refrigeration loads. Overchilling of the water cooler can result in freezing of the water within the water reservoir and related dispense flow conduits, to render the water cooler inoperative and potentially cause freeze damage to water cooler components.

The present invention is directed to an improved combination water cooler and refrigerator unit having a refrigeration system of relatively economical capacity and including a single or common thermostatic temperature control sensor for regulating on-off operation of the refrigeration system, and further wherein the water-containing reservoir of the water cooler is positioned in heat transfer relation with the refrigerated compartment to substantially preclude overchilling of either the water cooler or the refrigerated compartment.

SUMMARY OF THE INVENTION

In accordance with the invention, a combination water cooler and refrigerator unit is provided including a lower cabinet defining a refrigerated compartment, and an upper water reservoir for receiving a supply of water from a water source, such as an inverted water bottle. A refrigeration system includes a chiller coil having a first segment for chilling the refrigerated compartment, and a second segment for chilling water within the water reservoir. A single thermostatic temperature control sensor is mounted within the refrigerated compartment regulating operation of the refrigeration system. To prevent overchilling of the water reservoir or the refrigerated compartment, a portion of the water reservoir such as a lower end thereof is disposed in thermal communication with the refrigerated compartment such as an upper region thereof.

In the preferred form, the lower cabinet houses the refrigeration system including a compressor for pressurizing a suitable refrigerant circulated thereto via a condenser grid mounted at a rear side of the cabinet. The pressurized refrigerant is expanded for substantial temperature reduction and circulated through the chiller coil, sometimes referred to as the evaporator coil, for chilling the refrigerated compartment and the water reservoir. The chiller coil first segment is positioned within or in heat transfer relation with the refrigerated compartment for chilling the interior thereof, and the chiller coil second segment is positioned about or in heat transfer relation with at least a portion of the water reservoir to chill water contained therein. In the preferred configuration, these first and second segments of the chiller coil are connected in-line and thus comprise different segments of a common or single chiller coil. The refrigerated compartment and the water reservoir are suitably insulated, and a door is provided for convenient access to the refrigerated compartment.

The single thermostatic temperature control sensor is mounted, in the preferred form, within the refrigerated compartment at a position in relatively close proximity to the water reservoir, as by mounting onto or in close proximity with the chiller coil first segment at a location spaced rearwardly from the door. This temperature control sensor monitors the temperature within the refrigerated compartment and functions to turn the refrigeration system on when chilling is required, and to turn the refrigeration system off when chilling is not required.

In accordance with one aspect of the invention, the chilled portion of the water reservoir is positioned in thermal or heat transfer communication with the refrigerated compartment, so that hot or cold thermal loads represented by these two portions of the combined unit are shared. That is, warm water added to the reservoir tends to elevate the temperature within the refrigerated compartment, whereas unchilled or warm items placed into the refrigerated compartment tend to elevate the temperature of the water within the reservoir. Alternately stated, the refrigerated compartment assists in chilling warm water added to the reservoir, whereas chilled water in the reservoir assists in cooling warm items placed into the refrigerated compartment. In either case, the presence of a chiller load at one portion of the combined unit causes the temperature control sensor to turn on the refrigeration system to provide the requisite temperature reduction, substantially without overchilling the other portion of the combined unit.

Other features and advantages of the invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
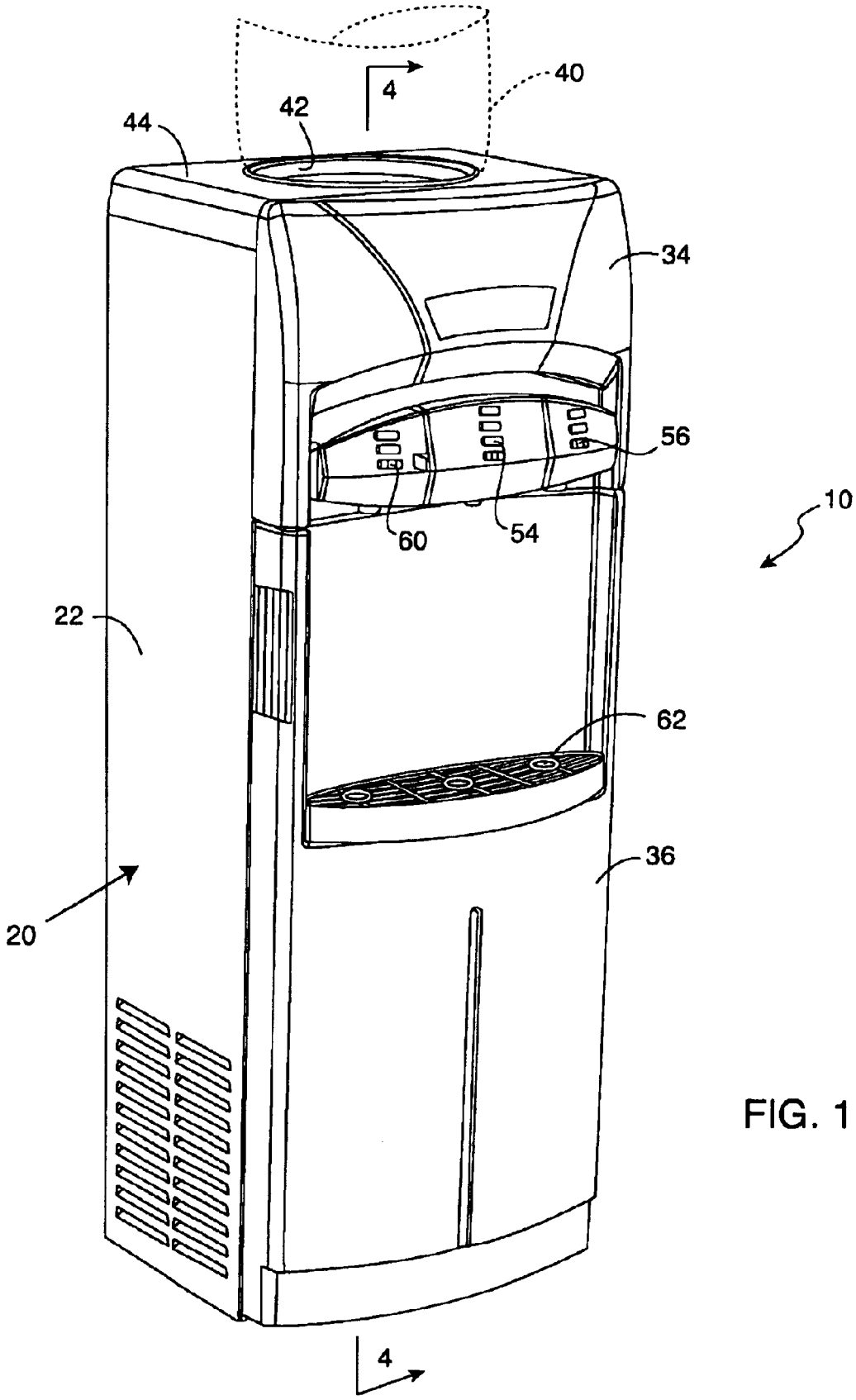
FIG. 1 is a front perspective view illustrating a combined water cooler and refrigerator unit in accordance with the present invention.

As shown in the exemplary drawings, a combined water cooler and refrigeration unit referred to generally in FIGS. 1–4 and 7–9 by the reference numeral 10 is provided, to include an upper reservoir 12 (FIGS. 3–9) for containing a supply of chilled water and a lower refrigerated compartment 14 (FIGS. 2–4 and 7–9) for receiving items such as canned or bottled beverages and the like. A refrigeration system including a chiller coil 16 (FIGS. 2–9) has a first segment 17 for chilling water within at least a portion of the water reservoir 12, and a second segment 18 for chilling the refrigerated compartment 14. The water reservoir 12 is positioned in thermal communication with the refrigerated compartment so that hot or cold thermal loads represented by these two portions of the combined unit are shared. This arrangement permits use of a single thermostatic temperature control sensor 19 (FIGS. 5–7) to regulate cyclic operation of the refrigeration system, without significant risk of overchilling water within the reservoir 12 or items stored within the refrigerated compartment 14.

Figure 2:
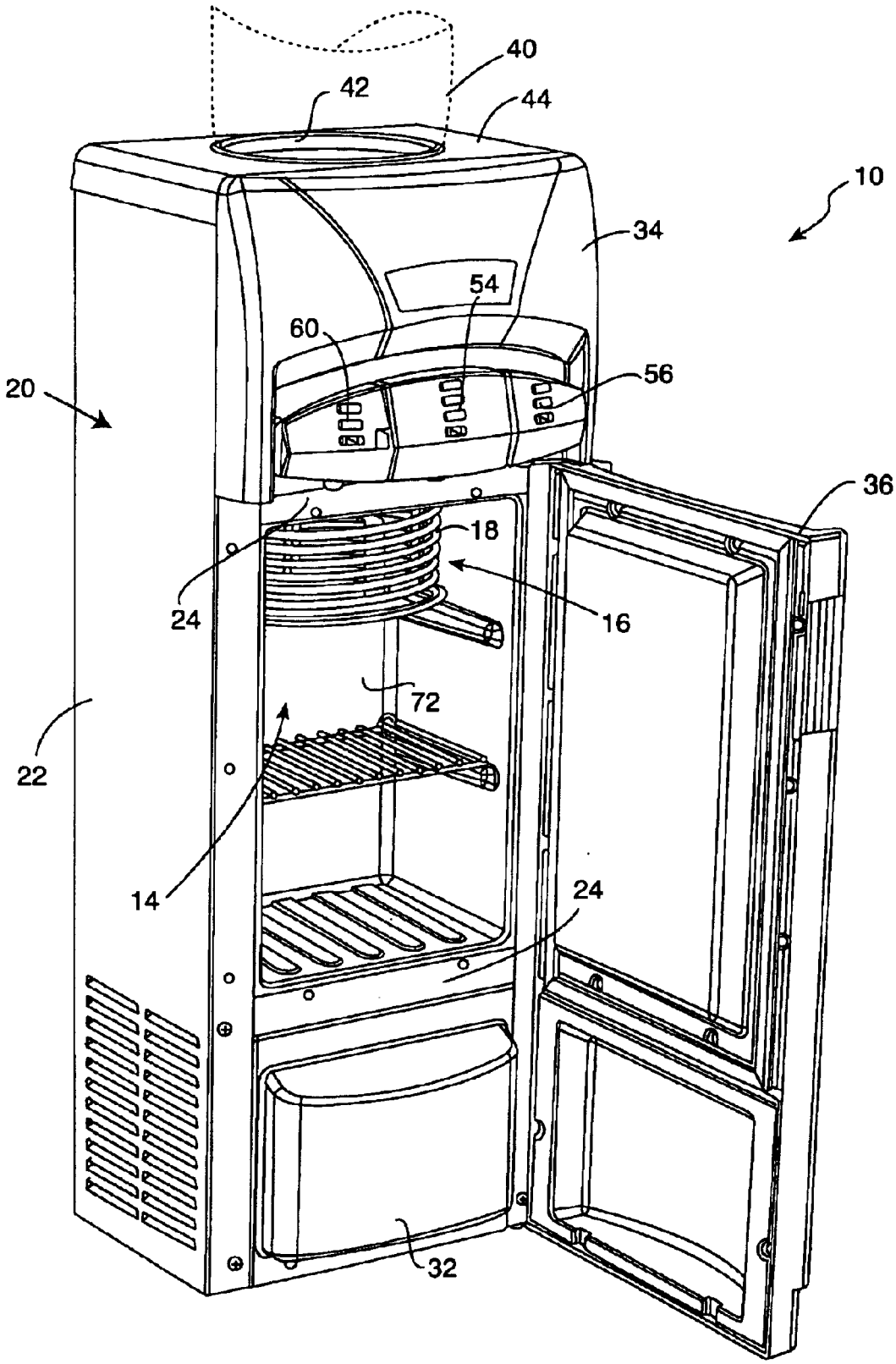
FIG. 2 is a front perspective view of the unit depicted in FIG. 1, with a cabinet door in an open position to expose a refrigerated compartment.
Figure 3:
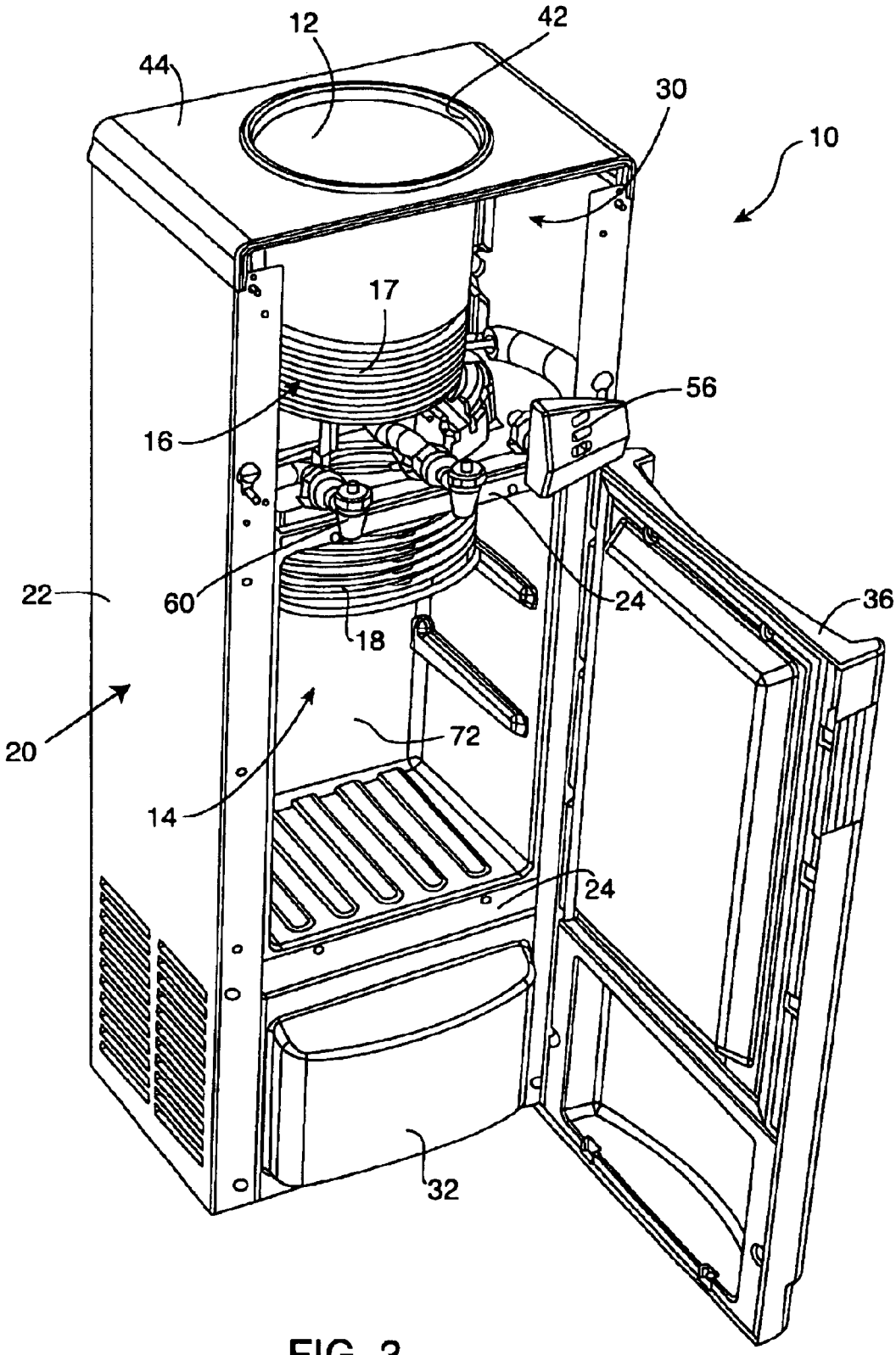
FIG. 3 is a front perspective view similar to FIG. 2, but having cabinet portions removed to expose a water reservoir mounted within an upper portion of the cabinet.

As viewed generally in FIGS. 1–3 with respect to one illustrative preferred configuration of the invention, the combined unit 10 includes a lower housing or cabinet 20 having generally upright side walls 22 assembled with internal frame members 24 to define a generally upright rectangular structure. These elements of the cabinet 20 cooperatively define the refrigerated compartment 14 (FIGS. 2–4 and 7–9) positioned therein generally centrally between a lower compressor compartment 26 (FIGS. 4 and 7) having a compressor 28 forming a portion of the refrigeration system mounted therein, and an upper reservoir or cooler compartment 30 (FIGS. 3–4 and 7–9) having the water reservoir 12 mounted therein. A front side of the compressor compartment 26 is normally closed by a service panel 32 (FIGS. 2–4), and a front side of the cooler compartment 30 is closed by an external front cabinet panel 34. A hinged door 36 is mounted on the cabinet 20 for swinging movement between a normally closed position (FIGS. 1, 4 and 9) closing a front side of the refrigerated compartment 14, and an open position (FIGS. 2, 3 and 8) permitting access to the interior of the refrigerated compartment 14. Insulation 38 is provided within the cabinet 20 and within or on the door 36 for suitably insulating the refrigerated compartment 14. In addition, in the configuration of the invention as shown, a lower portion of the door 36 may extend over and cover the service panel 32 of the compressor compartment 26.

The cooler reservoir 12 is shown in the form of a generally cylindrical container mounted within the upper cooler compartment 30 of the cabinet 20, to define an upwardly open structure for receiving and storing a supply of water ready for on-demand dispensing. In one preferred arrangement, the reservoir 12 is supplied with relatively pure water from a source such as an inverted water bottle 40 depicted in dotted lines in FIGS. 1–2 and 4. In such arrangement as shown, the open upper end of the reservoir 12 is positioned in alignment with an opening 42 formed in a cover panel or lid 44 of the cabinet 20. Alternately, persons skilled in the art will recognize and appreciate that the reservoir 12 may be supplied with water from an alternative source, such as by connection to a relatively purified water output from a purification system (not shown) such as a filter and/or reverse osmosis purification system. In such alternative, it will be understood that the upper end of the reservoir 12 may be closed, and that a modified lid omitting the opening 42 may be provided.

Figure 4:
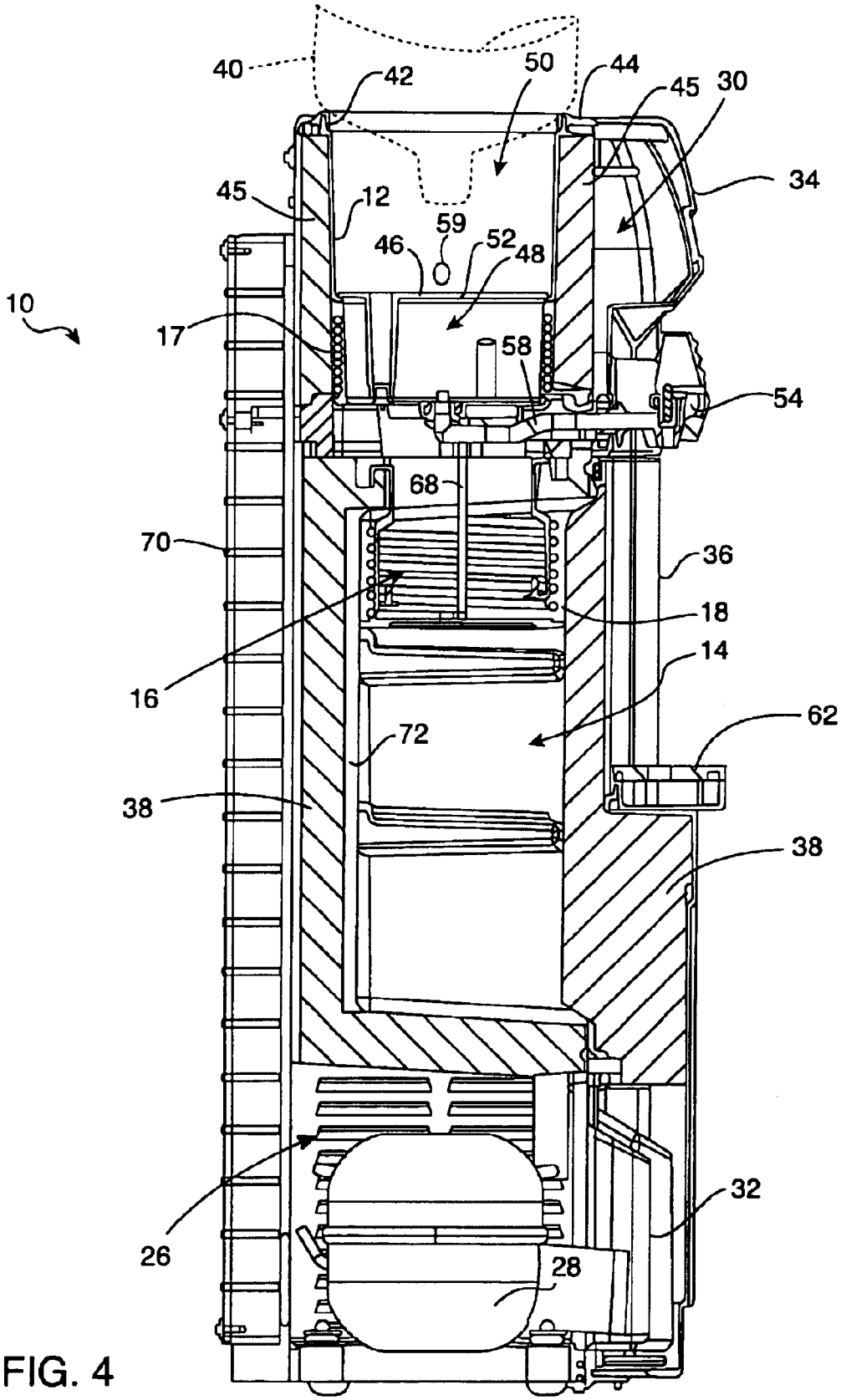
FIG. 4 is a vertical sectional view taken generally on the line 4—4 of FIG. 1.
Figure 9:
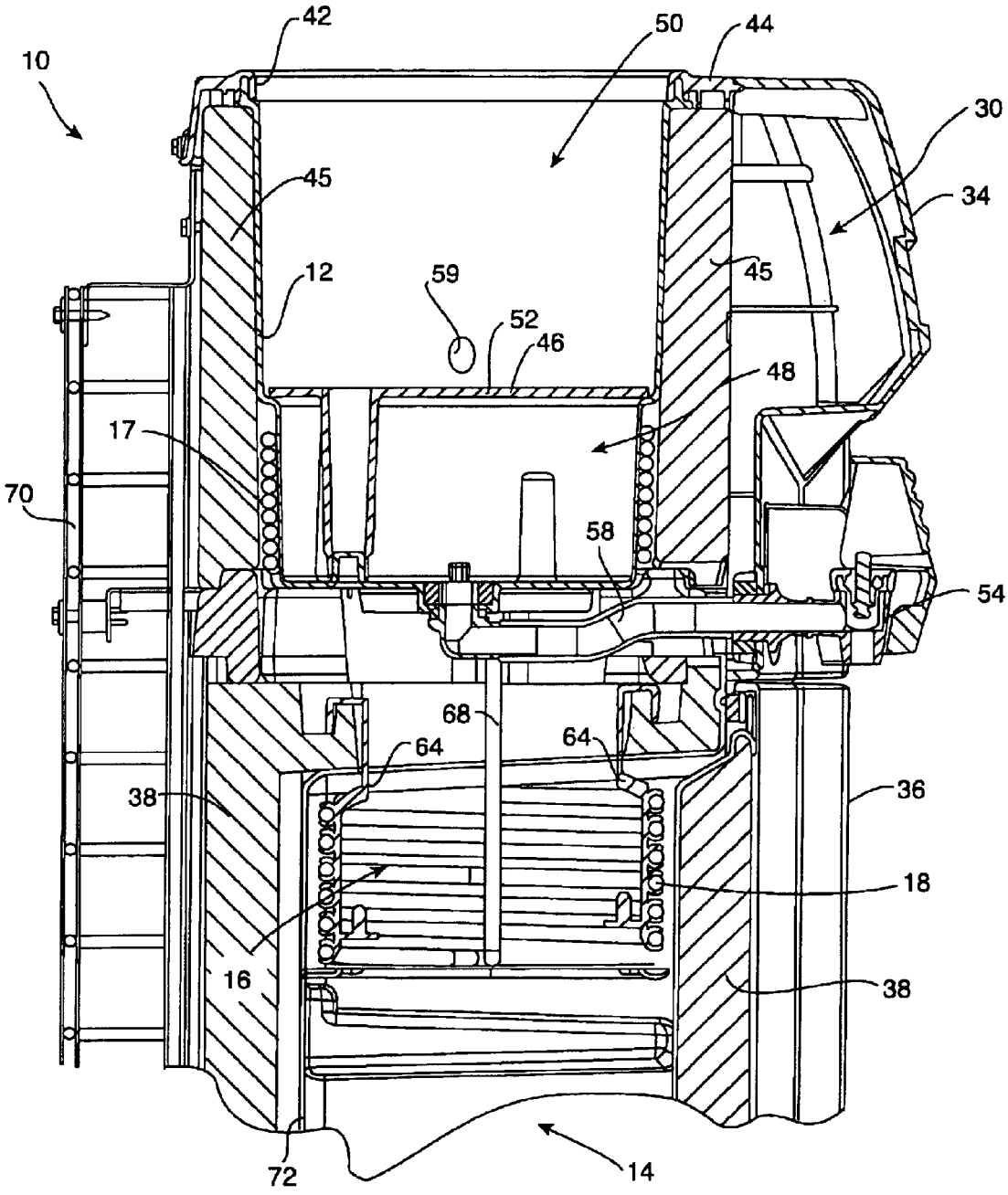
FIG. 9 is an enlarged and fragmented vertical sectional view corresponding generally with an upper region of FIG. 4.

In the illustrative drawings, the water reservoir 12 has a baffle 46 (FIGS. 4 and 9) mounted therein for subdividing the reservoir interior volume into a lower chilled chamber 48 and an upper substantially unchilled chamber 50. Water from the inverted bottle 40 or other suitable water supply source is delivered into the upper chamber 50 and flows downwardly therefrom via a relatively small aperture 52 in the baffle 46 to fill the lower chamber 48. Separate faucet valves 54 and 56 are mounted on the front panel 34 at a location above the hinged door 36 for separately dispensing water respectively via associated waterways from the chilled lower chamber 48 and the unchilled upper chamber 50. In this regard, FIGS. 4 and 9 depict a water flow conduit 58 connected between the chilled chamber 48 and the chilled water faucet valve 54, whereas FIGS. 4, 6, 8 and 9 depict a water flow conduit 59 connected between the unchilled upper chamber 50 and the second faucet valve 56 for dispensing unchilled water substantially at room temperature. In addition, the reservoir 12 may be coupled to an auxiliary hot water supply tank 53 (FIG. 7) equipped with a heating element (not shown) for providing a supply of hot water which can be dispensed by means of an additional hot water faucet valve 60 (FIGS. 1–2 and 8) also mounted on the front panel 34 of the cabinet 20. The hot water tank 53 may be coupled for water inflow from the unchilled upper chamber 50 via a supply conduit 55 (FIGS. 5–6) or the like, and a vent conduit 57 may also be provided for venting the hot water tank 53 to the upper chamber 50. Such water cooler arrangement, including the multiple chambers and related faucet valves and associated waterways, is known in the art and therefore is not shown or described in further detail herein. It will be recognized that a drip tray 62 (FIGS. 1 and 4) may be included on an outboard side of the door 36, at a location underlying the faucet valves 54, 56 and 60.

In accordance with one important aspect of the invention, the chilled lower region or lower chamber 48 of the reservoir 12 is positioned in heat transfer relation with an upper region of the underlying refrigerated compartment 14. This arrangement is implemented, in the preferred form, by wrapping the reservoir 12 with suitable insulation 45 (FIGS. 4, and 7–9), but leaving a bottom wall of the reservoir exposed directly to and thereby defining a top wall for the underlying refrigerated compartment 14 (as viewed best in FIGS. 4 and 9). Thermal communication between the chilled lower chamber 48 of the reservoir 12 with the underlying refrigerated compartment 14 may be further enhanced by forming the reservoir 12 from a metal material having relatively high thermal conductivity. With this construction, a thermal load encountered by either one of the water reservoir 12 or the refrigerated compartment 14 is shared by the other component of the combined unit 10.

The refrigeration system comprises the compressor 28 mounted within the lower compressor compartment 26, for pressurizing a suitable refrigerant which is then expanded and circulated through a capillary tube 61 or the like (FIGS. 5–6) to the chiller coil 16 for reducing the temperature within the refrigerated compartment 14, and also for chilling water within the reservoir 12. More particularly, in the preferred configuration as shown, the chiller coil 16 comprises a single or common chiller coil including the second segment 18 supported on a hanger bracket 64 in a coiled geometry within an upper region of the refrigerated compartment 14, and the first segment 17 wrapped closely in heat transfer relation about the lower region of the reservoir 12 defining the chilled lower chamber or compartment 48. Accordingly, these chiller coil segments 17 and 18 are coupled in-line, as by means of a transition leg 68 as viewed in FIGS. 4–6 and 9. The expanded refrigerant circulated through these segments 17, 18 of the chiller coil 16 is circulated in turn through a return conduit 69 (FIGS. 5–8) and a condenser grid 70 (FIGS. 4 and 7–9) which may be conveniently mounted onto a rear side of the cabinet 20 before recirculation back to the compressor 28.

In the preferred form, a single or common thermostatic temperature control sensor 19 (FIGS. 5–7) is provided for regulating operation of the refrigeration system. In this regard, the temperature control sensor 19 is mounted at a position for detecting the presence of a thermal load, as represented by an increased detected temperature, requiring energization of the refrigeration system for chilling either the water reservoir 12 or the refrigerated compartment 14. When such load is detected, the sensor 19 turns the refrigeration system on for chilling sufficiently to reduce the detected temperature to a predetermined threshold level at which point the sensor 19 turns off the refrigeration system.

Figure 5:
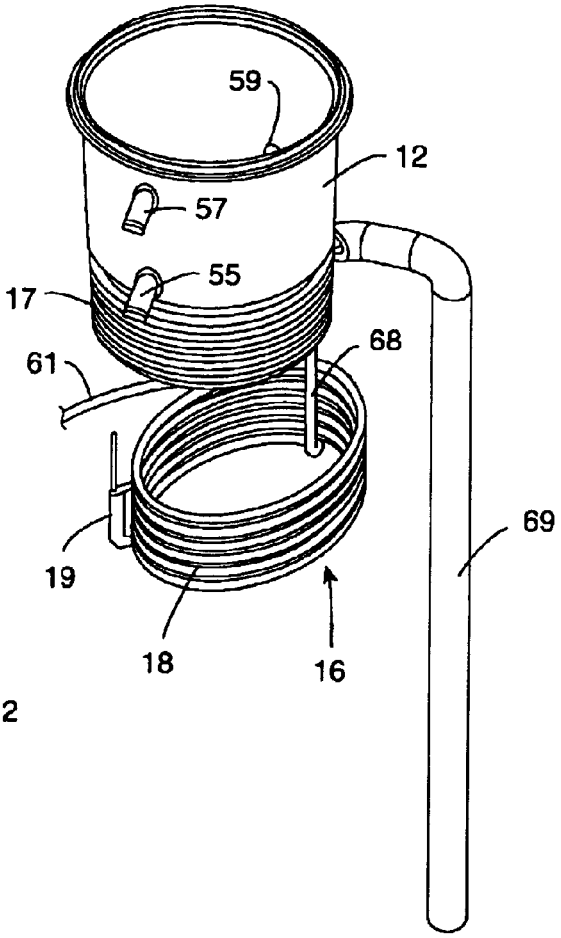
FIG. 5 is a perspective view illustrating the front, top and left sides of an exemplary chiller coil including a lower first segment for chilling the refrigerated compartment, and an upper second segment for chilling the water reservoir.
Figure 6:
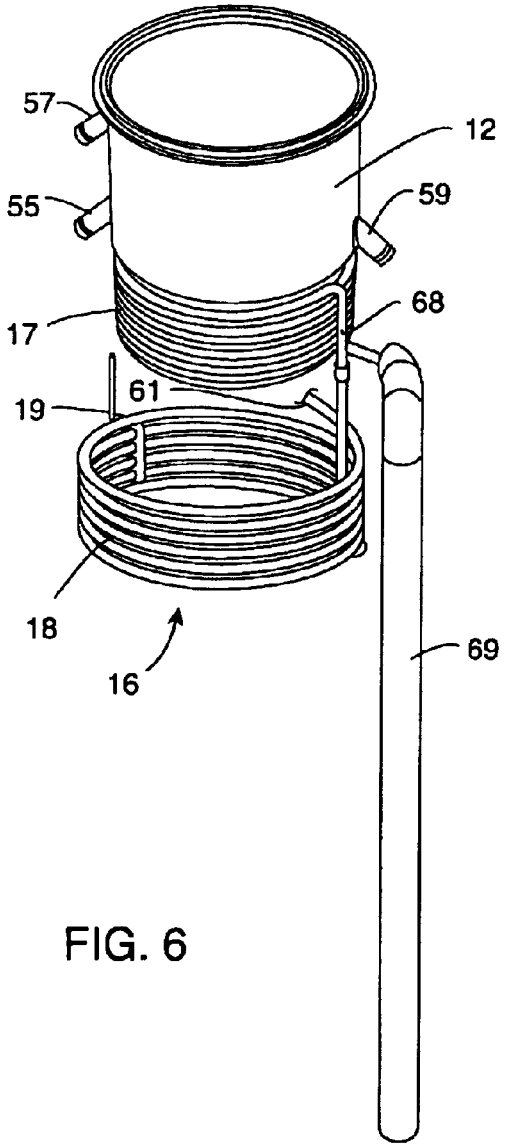
FIG. 6 is a top and right side perspective view of the exemplary chiller coil of FIG. 5.
Figure 7:
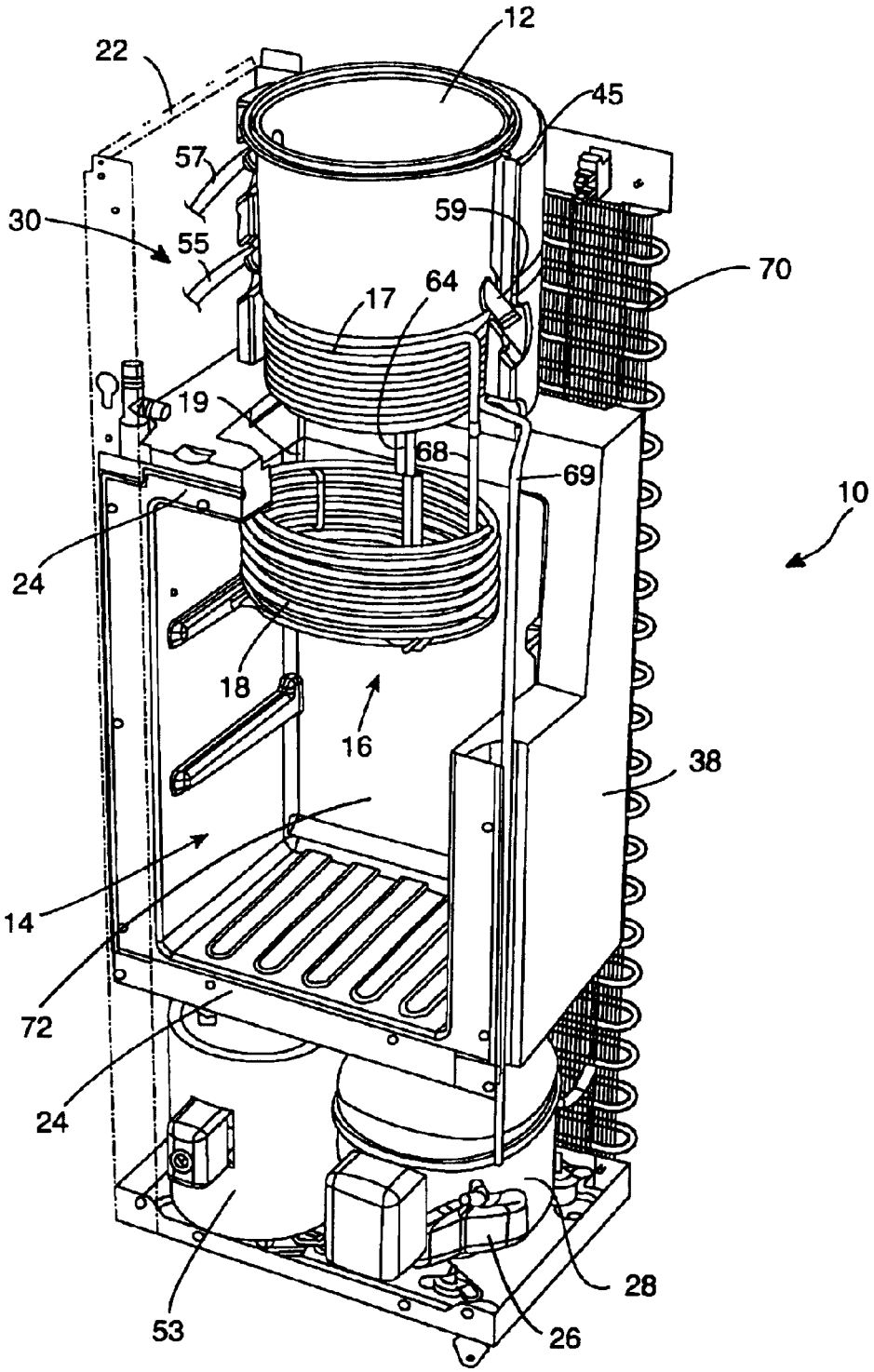
FIG. 7 is a front perspective view similar to FIG. 3, but having additional cabinet portions removed to expose components of a refrigeration system and additionally to exposed a hot water supply tank.
Figure 8:
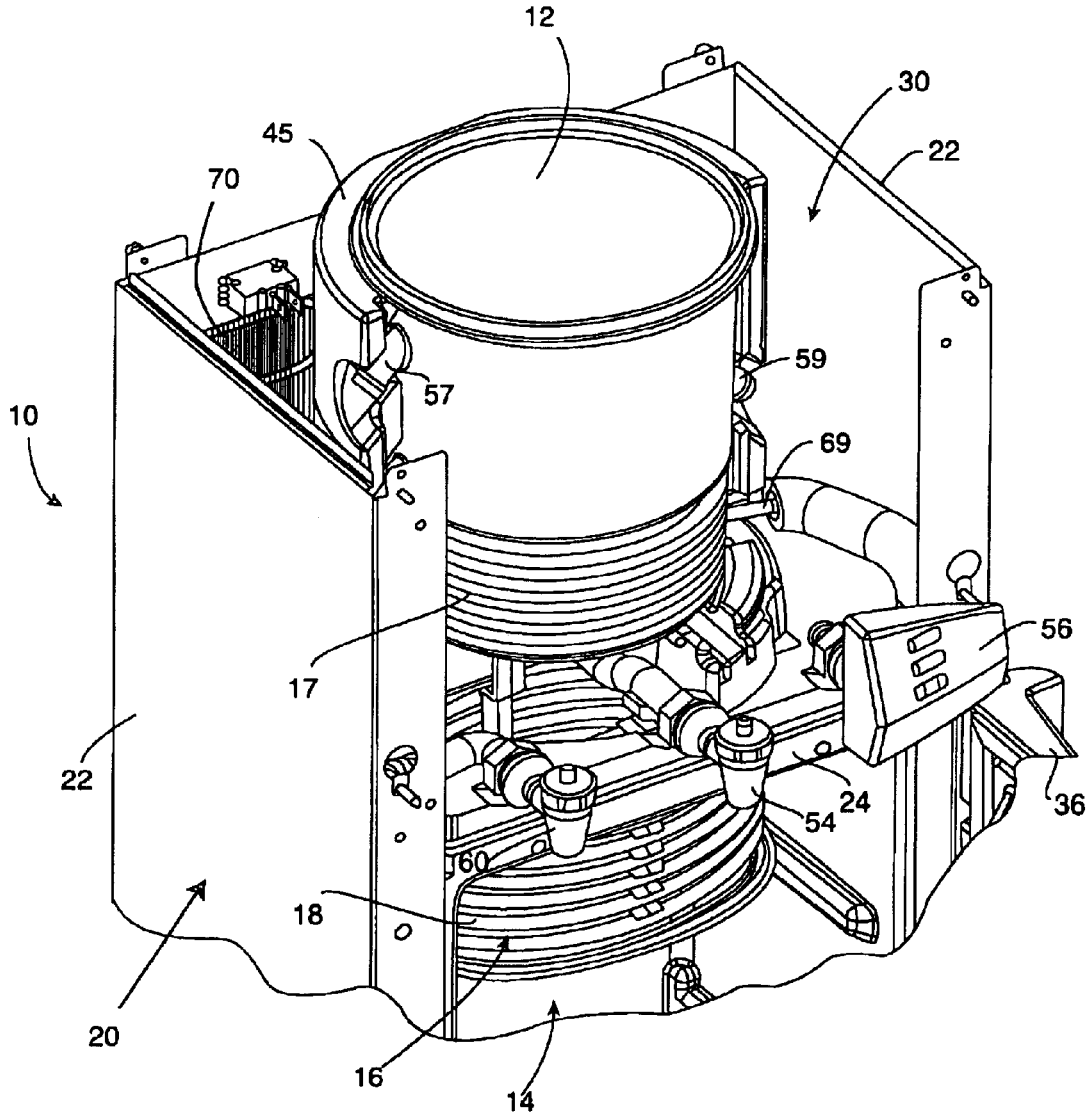
FIG. 8 is an enlarged and fragmented perspective view similar to an upper region of FIG. 3, with further cabinet portions removed to illustrate the water reservoir of the combined unit.

FIGS. 5–7 show the temperature control sensor 19 mounted generally at or on a rear wall 72 of the refrigerated compartment 14, at a location generally at or within an upper region of the refrigerated compartment and mounted on or in relatively close proximity to the second segment 18 of the chiller coil 16. As a result, the sensor 19 is also positioned in relatively close proximity to the overlying bottom wall of the lower chilled chamber 48 of the water reservoir 12.

The temperature sensor 19 thus detects elevated temperature generally within an upper region of the refrigerated compartment 14, wherein such elevated temperature can result from a thermal load represented by placement of warm or unchilled items such as canned or bottled beverages into the refrigerated compartment 14. In such event, the sensor 19 turns the refrigeration system on to provide chilling, in cooperation with the overlying chilled water within the reservoir 12, to reduce the temperature to the predetermined lower limit at which time the sensor 19 turns off the refrigeration system. Importantly, during such chilling cycle, the thermal communication between the overlying reservoir 12 and the underlying refrigerated compartment 14 prevents overchilling of the reservoir 12, and thereby also substantially precludes undesired freeze-up of the reservoir or associated waterways and faucet valves.

Alternately, the elevated temperature detected by the sensor 19 can result from a thermal load represented by significant addition of unchilled water to the lower chamber 48 of the reservoir 12. In this case, the sensor 19 again turns on the refrigeration system which cooperates with the underlying refrigerated compartment to chill the water sufficiently to reduce the temperature to the predetermined lower limit at which time the sensor 19 again turns off the refrigeration system. As before, during such chilling cycle, the thermal communication between the overlying reservoir 12 and the underlying refrigerated compartment 14 prevents overchilling of the refrigerated compartment 14, and thereby also substantially precludes undesired freeze-up of items contained within the refrigerated compartment.

Figure 10:
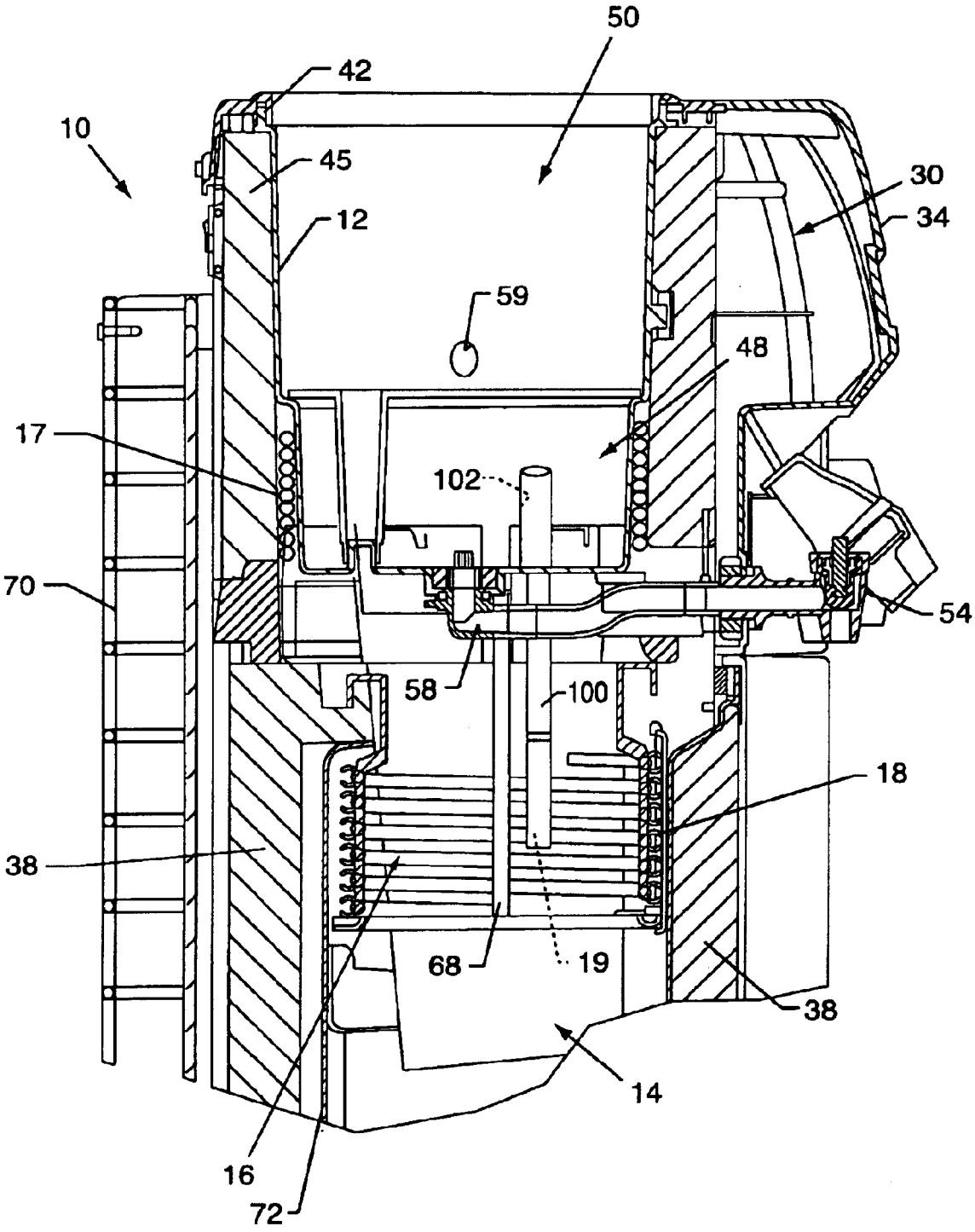
FIG. 10 is an enlarged and fragmented vertical sectional view corresponding generally with FIG. 9, but showing one alternative preferred form of the invention.
Figure 11:
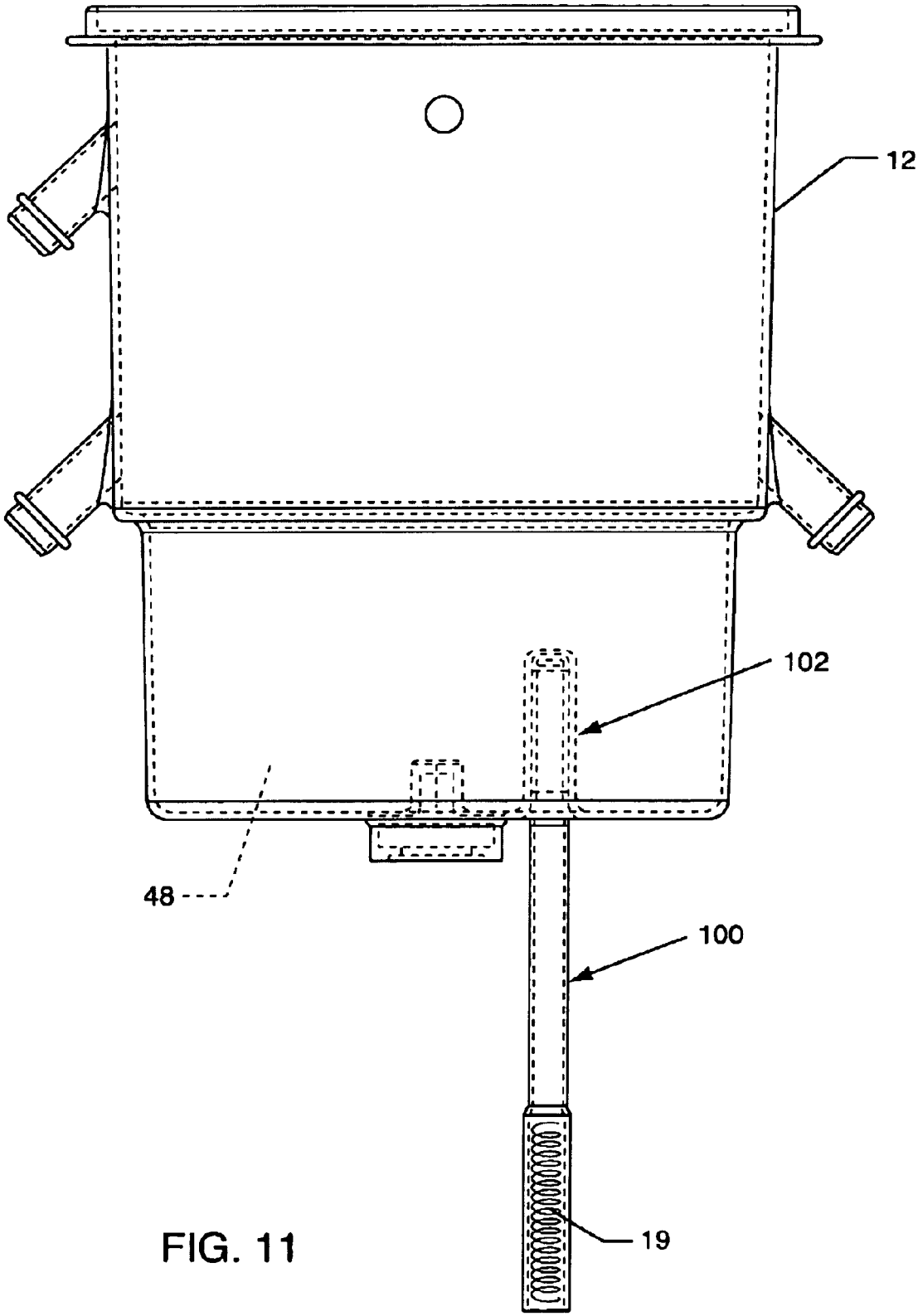
FIG. 11 is an enlarged side elevation view of a water reservoir for use in the alternative embodiment of FIG. 10.

FIGS. 10–11 illustrate the invention in accordance with one alternative preferred form thereof, wherein components corresponding with those shown and described with respect to FIGS. 1–9 are identified by common reference numerals. As shown, this alternative embodiment incorporates a thermally conductive element 100 such as a length of copper tubing mounted to extend in heat transfer relation between the two thermal loads defined by the refrigerated compartment 14 and the chilled water within the overlying reservoir 12. In particular, opposite ends of this conductive element 100 are positioned respectively in heat transfer relation with the two thermal loads, and the temperature sensor 19 is mounted within the conductive element 100, whereby temperature fluctuations occurring at either of the two thermal loads are rapidly transmitted by conduction to the temperature sensor 19 for correspondingly rapid response as by turning the refrigeration system on or off, as appropriate.

More particularly, the thermally conductive element 100 may comprise a hollow tube or the like formed from a material selected for high thermal conductivity, such as copper, wherein this tube is mounted to extend between the two thermal loads. In the preferred form as shown best in FIG. 11, an upper end of the conductive element 100 can be press-fitted or similarly seated within a downwardly open pocket 102 formed in the bottom wall of the reservoir 12, so that this upper end of the conductive element 100 is disposed in good thermal contact with the reservoir and water contained within the chilled lower chamber 48 thereof. From the reservoir bottom wall, the conductive element 100 protrudes downwardly into the upper region of the refrigerated compartment 14, preferably terminating at a location generally within the volume circumscribed by the lower coil segment 18 and thus positioned in good thermal association with the refrigerated compartment 14. The temperature sensor 19 is seated within a lower end of the conductive element 100, within the refrigerated compartment 14.

In operation, the conductive element 100 provides a thermal coupling between the temperature sensor and the reservoir 12, and also between the temperature sensor and the refrigerated compartment 14, so that the sensor 19 may detect and respond more rapidly to temperature fluctuations encountered by either one of the two thermal loads. That is, by way of example, elevation of the water temperature within the reservoir 12 will be detected more rapidly by the sensor 19, resulting in more rapid energization of the refrigeration system for reducing the water temperature. Similarly, as the water is chilled to a desirable and pre-set low temperature limit, the sensor 19 will detect the water temperature change more rapidly for purposes of de-energizing the refrigeration system.

A variety of further modifications and improvements in and to the combined water cooler and refrigerator unit 10 of the present invention will be apparent to those persons skilled in the art. Accordingly, no limitation on the invention is intended by way of the foregoing description and accompanying drawings, except as set forth in the appended claims.

What is claimed is:

1. A combination water cooler and refrigerator unit, comprising:

a water reservoir for receiving a supply of water;

a housing defining a refrigerated compartment;

a refrigeration system including a chiller member having a first segment in heat transfer relation with said reservoir for chilling water within at least a portion of said reservoir, and a second segment for chilling the refrigerated compartment;

said reservoir having at least a portion thereon disposed in thermal communication with the refrigerated compartment; and a temperature control sensor for regulating operation of said refrigeration system.

2. The combination water cooler and refrigerator unit of claim 1 wherein said reservoir is positioned above the refrigerated compartment and has a bottom wall thereof in thermal communication with and defining a top wall of the refrigerated compartment.

3. The combination water cooler and refrigerator unit of claim 2 wherein said reservoir is formed from a metal material.

4. The combination water cooler and refrigerator unit of claim 1 wherein said chiller member comprises a chiller coil.

5. The combination water cooler and refrigerator unit of claim 4 wherein said first segment of said chiller coil is wrapped about at least a portion of said reservoir, and wherein said second segment of said chiller coil is positioned generally within an upper region of the refrigerated compartment.

6. The combination water cooler and refrigerator unit of claim 5 wherein said first and second segments of said chiller coil are connected in-line.

7. The combination water cooler and refrigerator unit of claim 1 wherein said temperature control sensor comprises a single sensor mounted within the refrigerated compartment.

8. The combination water cooler and refrigerator unit of claim 7 further including a thermally conductive element mounted in heat transfer relation with said refrigerated compartment and with said reservoir, said temperature control sensor being carried by said thermally conductive element.

9. The combination water cooler and refrigerator unit of claim 1 further including at least one faucet for dispensing water from said reservoir.

10. A combination water cooler and refrigerator unit, comprising:

a water reservoir for receiving a supply of water, said reservoir defining a bottom wall;

a housing defining a refrigerated compartment underlying said reservoir whereby said reservoir bottom wall forms a top wall of said compartment;

a refrigeration system including a chiller member having a first segment in heat transfer relation with said reservoir for chilling water within at least a portion of said reservoir, and a second segment for chilling the refrigerated compartment;

said reservoir bottom wall being disposed in thermal communication with the refrigerated compartment; and a temperature control sensor for regulating operation of said refrigeration system.

11. The combination water cooler and refrigerator unit of claim 10 wherein said reservoir is formed from a metal material.

12. The combination water cooler and refrigerator unit of claim 10 wherein said chiller member comprises a chiller coil having said first segment wrapped about at least a portion of said reservoir, and said second segment positioned generally within an upper region of the refrigerated compartment.

13. The combination water cooler and refrigerator unit of claim 12 wherein said first and second segments of said chiller coil are connected in-line.

14. The combination water cooler and refrigerator unit of claim 10 wherein said temperature control sensor comprises a single sensor mounted within the refrigerated compartment.

15. The combination water cooler and refrigerator unit of claim 14 further including a thermally conductive element mounted in heat transfer relation with said refrigerated compartment and with said reservoir, said temperature control sensor being carried by said thermally conductive element.

16. The combination water cooler and refrigerator unit of claim 10 further including at least one faucet for dispensing water from said reservoir.

17. A combination water cooler and refrigerator unit, comprising:

a housing defining an upper reservoir compartment and a lower refrigerated compartment;

a water reservoir mounted within said upper reservoir compartment, said reservoir defining a bottom wall and being adapted for receiving a supply of water;

at least one faucet on said housing for dispensing water from said reservoir;

a door movable between open and closed positions for respectively permitting and preventing access to said refrigerated compartment;

a refrigeration system including a chiller member having a first segment in heat transfer relation with said reservoir for chilling water within at least a portion of said reservoir, and a second segment for chilling the refrigerated compartment;

said reservoir bottom wall being disposed in thermal communication with the refrigerated compartment; and a temperature control sensor for regulating operation of said refrigeration system.

18. The combination water cooler and refrigerator unit of claim 17 wherein said chiller member comprises a chiller coil having said first segment wrapped about at least a portion of said reservoir, and said second segment positioned generally within an upper region of the refrigerated compartment.

19. The combination water cooler and refrigerator unit of claim 18 wherein said first and second segments of said chiller coil are connected in-line.

20. The combination water cooler and refrigerator unit of claim 17 wherein said temperature control sensor comprises a single sensor mounted within the refrigerated compartment.

21. The combination water cooler and refrigerator unit of claim 20 further including a thermally conductive element mounted in heat transfer relation with said refrigerated compartment and with said reservoir, said temperature control sensor being carried by said thermally conductive element.

22. The combination water cooler and refrigerator unit of claim 20 wherein said sensor is mounted generally within an upper region of said refrigerated compartment.

* * * * *